US005472196A

United States Patent [19]

Rusnak

[11] Patent Number: 5,472,196

[45] Date of Patent: Dec. 5, 1995

[54] DISTRIBUTION OF ENTRY PIECES FOR LOTTERY GAMES OR THE LIKE

[75] Inventor: Kenneth R. Rusnak, Irving, Tex.

[73] Assignee: Bar Code Promotions, Inc., Irving, Tex.

[21] Appl. No.: 221,826

[22] Filed: Mar. 31, 1994

[51] Int. Cl.[6] ..... A63F 3/00

[52] U.S. Cl. ..... 273/138 R; 273/138 A

[58] Field of Search ..... 273/139, 138 A, 273/138 R

[56] References Cited

U.S. PATENT DOCUMENTS 5,129,652 7/1992 Wilkinson ..... 273/138 R 5,290,033 3/1994 Bittner et al. ..... 273/138 A

*Primary Examiner*—Benjamin H. Layno

*Attorney, Agent, or Firm*—Jack A. Kanz

[57] ABSTRACT

Game entry pieces for a second or subsequent game are automatically generated and dispensed to a participant in a first promotional lottery based game or the like at the time the entry piece for the first game is presented for winner determination status. The benefits of the first promotional game may thus be extended to the secondary game at minimum expense. The tie-in referral system may be used to collect and distribute demographic information about the participants.

23 Claims, 4 Drawing Sheets

STORE #033 REG #09 TRANS #202
CASHIER #104 11-3-93 10:42 AM

GORDON'S GLAMOUR INSTANT WIN GAME
YOU HAVE WON THE ENTIRE PAGE
OF JEWELRY ON PAGE 199!

TO CLAIM YOUR BONUS PRIZE, PRESENT
THIS RECEIPT TO STORE MANAGER
WITHIN ON HOUR OF THE DATE AND TIME
ON RECEIPT. REDEEM BY 12:42 AM 3-4-94.

GORDON'S GLAMOUR #000010100
SECURITY CODE # 999H321D
GORDON'S JEWELRY GIVEAWAY RECEIPT
VOID IF CODE DETACHED

WIN A TRIP TO HOLLYWOOD 10
OR
1,000 OTHER GREAT PRIZES 11

COME IN AND SCAN THIS BAR CODE
AT
BLOCKBUSTER VIDEO ... AND 12

SEE IF YOU ARE A WINNER!

COMPLETE PRIZE LIST AND GAME
RULES AVAILABLE AT ALL
PARTICIPATING STORES.

ZXZXZXZXZX 14

* 1 9 0 0 0 0 0 0 6 * 13

FIG. 3

DISTRIBUTION OF ENTRY PIECES FOR LOTTERY GAMES OR THE LIKE

This invention relates to lottery based games and contests. More particularly, it relates to methods and apparatus for distributing entry pieces or passes for lottery based games, contests and the like and to methods of collecting and using demographic information about the participants in such games and contests.

A wide variety of lotteries and similar games or contests in which participants are eligible to receive prizes awarded at random on the basis of predetermined odds of winning are commonly used for entertainment and promotion. In conventional lottery based games the participant either purchases or, in the case of promotional lotteries, is given a lottery ticket which has a lottery number inscribed on it. The lottery number on each ticket is unique and serves to distinguish it from other lottery tickets in the same lottery game. A winning number is later determined by random selection from a set of numbers which exactly match the set of lottery numbers in distribution. The winning number may be determined in other ways as long as it is insured that accurate prediction of the winning number is highly improbable. In such conventional lotteries, the winning number is non-existent until the moment it is selected randomly or determined according to other criteria.

In games where the winner is later determined, security is usually provided by generating the lottery numbers under computer control. Ordinarily, every lottery ticket in a given game has a serial number associated with it which is printed on each ticket to identify the game, ticket lot and the individual ticket itself. The lottery number for a given ticket is generated by using a complex computer algorithm which provides a unique relationship between the serial number and the lottery number for a given ticket. Whenever a winning lottery ticket is presented for redemption, a computer can be used to reverse the computer algorithm which generates the lottery number so that the interrelationship between the serial number and the lottery number of the presented ticket may be tested prior to payment of the prize.

In the case of instant lotteries, the winning lottery numbers are known before the ticket is distributed. Thus a participant may know within a short span of time after presenting his entry for validation whether or not he has won. In such instant lotteries, the operator of the lottery game either selects or determines on some basis the winning lottery numbers or related indicia which are made known to participants prior to their ticket purchase. However, the lottery number printed on the ticket is concealed so that the purchaser may ascertain the lottery number only after purchase of the lottery ticket has been consummated. The purchaser then exposes the concealed lottery number and the exposed number is compared against a list of winning numbers in order to determine if a match exists which entitles the ticket holder to a prize.

U.S. Letters Pat. No. 4,832,341 to Muller, et al. describes an instant lottery game wherein the lottery numbers may be presented in uncovered bar code form. This system employs a master program which provides a list of randomly generated lottery numbers (the universe of entries) from which a list of winning numbers is randomly selected. The universe of entries is divided into separate batches which are used to sequentially and instantaneously print the random lottery numbers (in bar code form) on coupons or the like to form game entry pieces. The game entry pieces may be preprinted and delivered to the game site or printed at the site of the game if desired. The coupon is read by a conventional bar code scanner which translates the bar code to a lottery entry which is then programmatically compared with the list of winning numbers to determine if it represents a winning entry. Accordingly, prizes can be awarded instantaneously.

Instant win games have become widely accepted as promotional schemes to attract potential purchasers to retail establishments. Games employing the unique, non-duplicating entry scheme of Muller, et al. are particularly appealing to the retailer since essentially any unique, non-duplicating identifier (such as a frequent-buyer card, a credit card, etc.) can be used as an entry piece for initiating play. Accordingly, a wealth of demographic information and specific information about each player can be determined from the buyer's use of his entry piece by collecting such information from the unique entry piece presented by the participant to enter the game.

Other promotional schemes are conducted using identical game entry pieces, such as tokens or coupons printed in newspaper advertisements and coded information such as UPC bar codes incorporated as part of the packaging for goods. Ordinarily, all the entry tokens or coupons used in such common entry schemes are identical. For example, coupons can be printed in a newspaper offering a discount on a specific item of merchandise in a store. However, U.S. Pat. No. 5,007,641 to Seidman describes an instant lottery game based on use of identical entry pieces wherein prizes may be randomly awarded to participants who use identical entry pieces to initiate game play.

While all the forgoing promotional schemes offer particular benefits for specific promotional schemes, they offer little, if any, opportunity to encourage the customers or patrons of one establishment to patronize a complimentary establishment or to determine the effectiveness of broadcast cross-selling such as distribution of advertising flyers in one store to attract its patrons to a complimentary store.

In accordance with the present invention, a direct tie-in and referral system is provided which encourages patrons of a first business establishment (such as a retail store or the like) to visit a second establishment so that the second establishment may enjoy the benefits of the promotional offerings of the first establishment while incurring only a small fraction of the costs. To effect the tie-in referral, the patron must participate in a lottery based game sponsored by the first establishment. When the player presents his entry piece for validation at the first establishment (to determine its winning status), the prize determination status is immediately displayed. In the preferred embodiment of the invention, the winner status is printed on a coupon, token or the like along with a bar code or the like which represents an entry piece for a second game played simultaneously (or later) at a second establishment. The customer at the first establishment is thus automatically provided with an entry piece for a game to be played at another location or establishment. The entry piece is preferably a bar code (either unique or common) printed on the display medium provided to display the winning status at the first game. Various other information may be recorded (preferably in coded form) on the printed coupon bearing the entry piece for the second game. Such information may then be collected at the site of the second game (or relayed to a remote location when the game piece is presented for winner validation to compare and correlate demographic and specific information about the party who participates in both games.

By utilizing the tie-in referral scheme of the invention, the benefits of a promotional lottery based game or the like sponsored by a first establishment may be extended to a second or other establishments at essentially no extra promotional cost. Thus two or more complimentary business establishments may share the expense of a promotional game. Furthermore, the effect of the tie-in promotion can be directly tracked and various demographic information about the customers of the establishments readily determined. Other features and advantages of the invention will become more readily understood from the following detailed description taken in connection with the appended claims and attached drawing in which:

FIG. 3 is a plan view of a typical second game entry piece generated in accordance with the invention.

Terms such as "game piece", "entry piece", "token", "coupon", and the like are used interchangeably herein to refer generally to any means for entry or initiating play in a promotional game, lottery, contest or the like. Such game pieces may be unique non-duplicating pieces which uniquely identify the holder (e.g. a bar code, credit card, identification card, etc.) or identical pieces (e.g. coupons, tokens or the like printed in newspapers or product codes appearing on product packaging). The form in which the game piece is displayed, of course, may vary as desired. For purposes of clarity, the game pieces discussed herein will be shown and described in the form of bar code since bar codes are commonly widely used. However, any other graphic, magnetic or other symbol which is machine-readable will suffice and may be considered equivalent for purposes of this disclosure.

Figure 1:
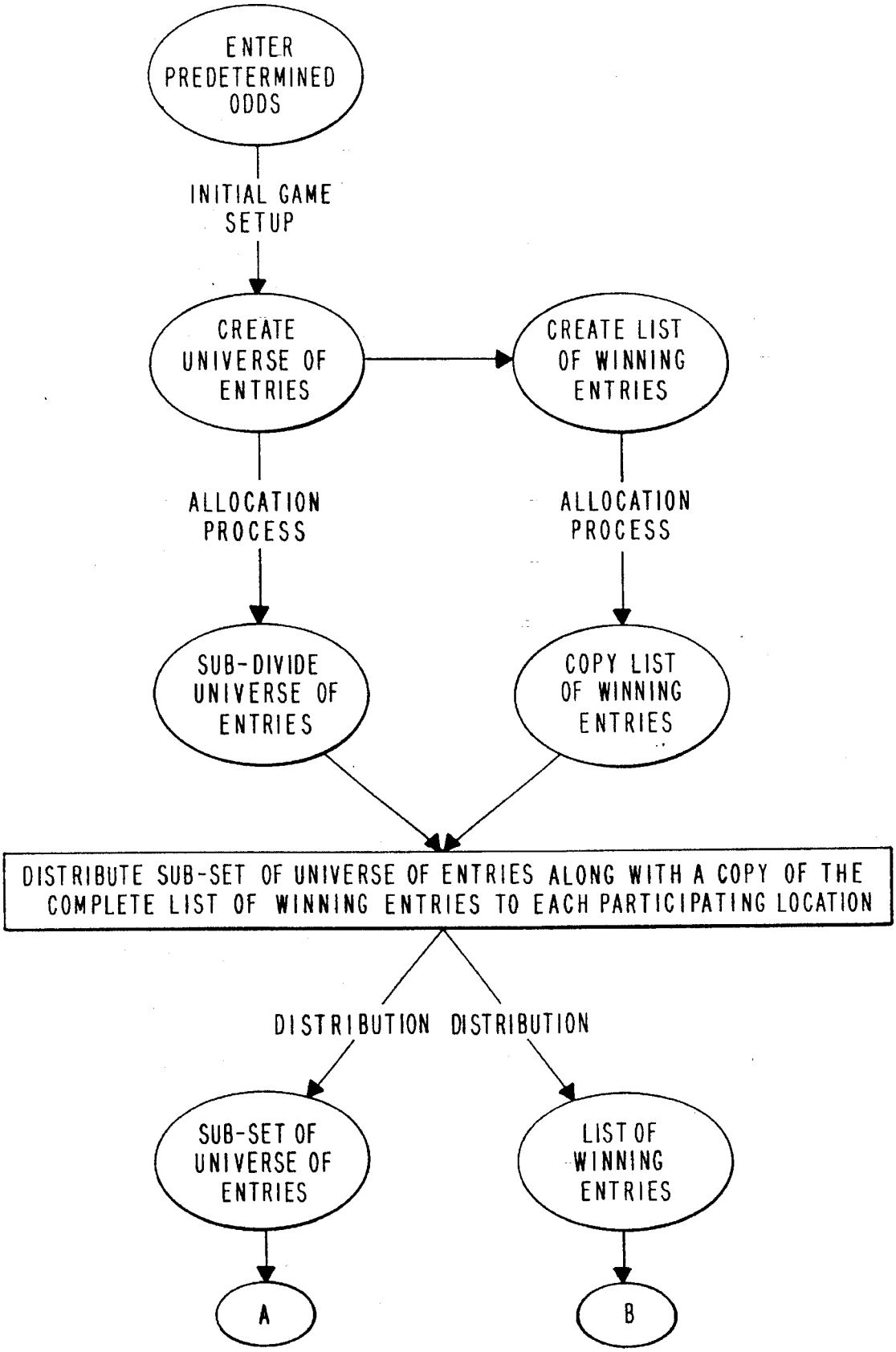
FIG. 1 is a schematic flow chart illustrating the game setup process for a typical first game used in the promotional gaming method of the invention.

A typical game setup for a game employing unique entry tokens is illustrated in flow chart form in FIG. 1. In order to operate a lottery based game with predetermined odds, the predetermined odds must first be determined and applied to a pre-selected universe of entries. With the universe of entries and predetermined odds established, the number of winning lottery numbers is selected by random number selection to create a list of winning entries. A subset of the universe of entries along with a copy of the complete list of winning entries may then be distributed to each location participating in the game and entry pieces generated and dispensed to the player for presentation at the site of the participating establishment or elsewhere, depending on the game being operated. Alternatively, the validation mechanism at each participating location may directly query a central location which retains the complete list of winning entries using direct communication links such as telephone lines, radio hook-ups or any suitable means to provide signal communication. The physical location of each component of the system is relatively insignificant so long as the participant can receive validation and display of the winner status of each entry at the most convenient location for the participant.

Figure 2:
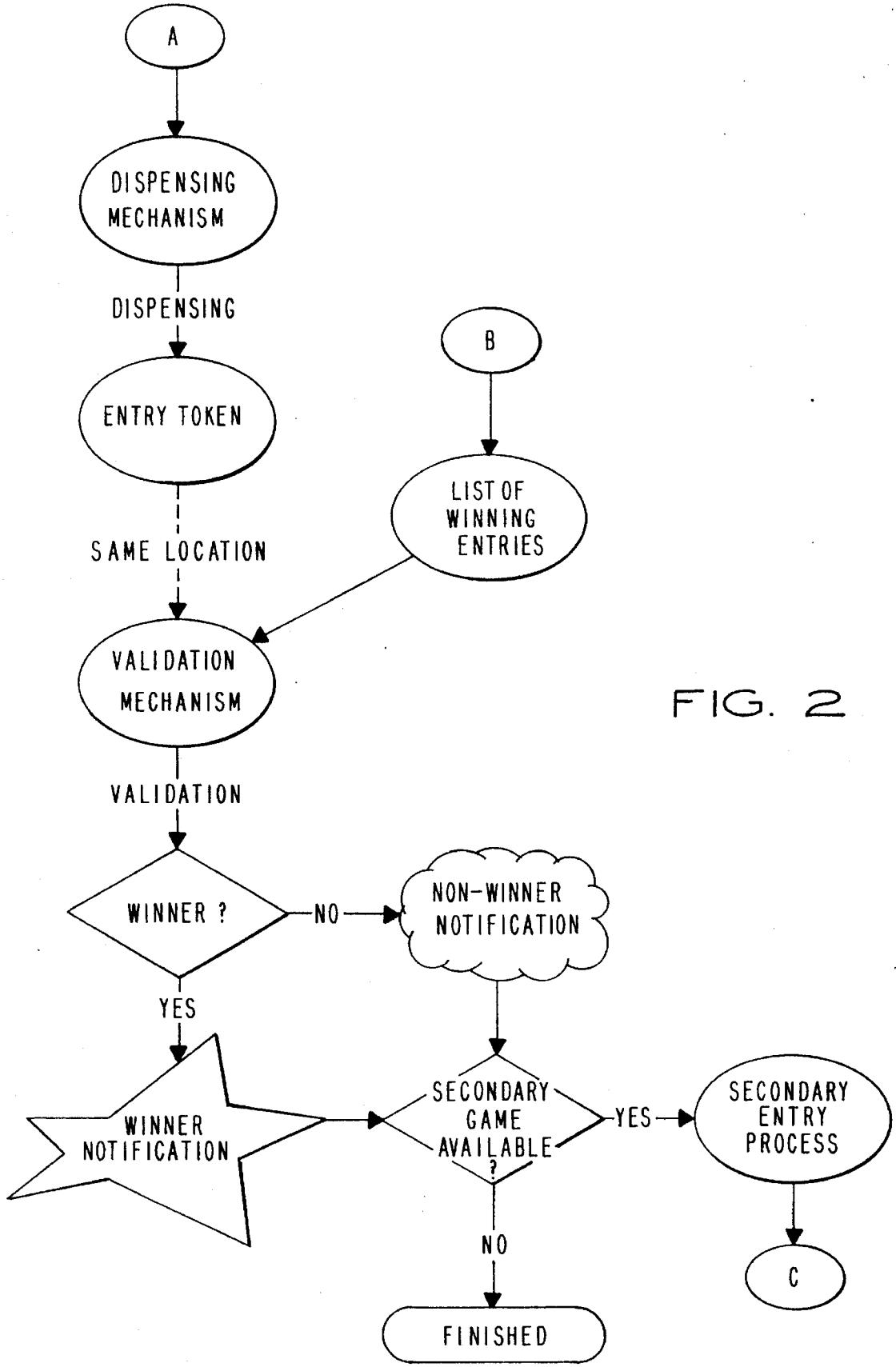
FIG. 2 is a schematic flow chart illustrating the playing steps of a typical first game component of the invention.
Figure 4:
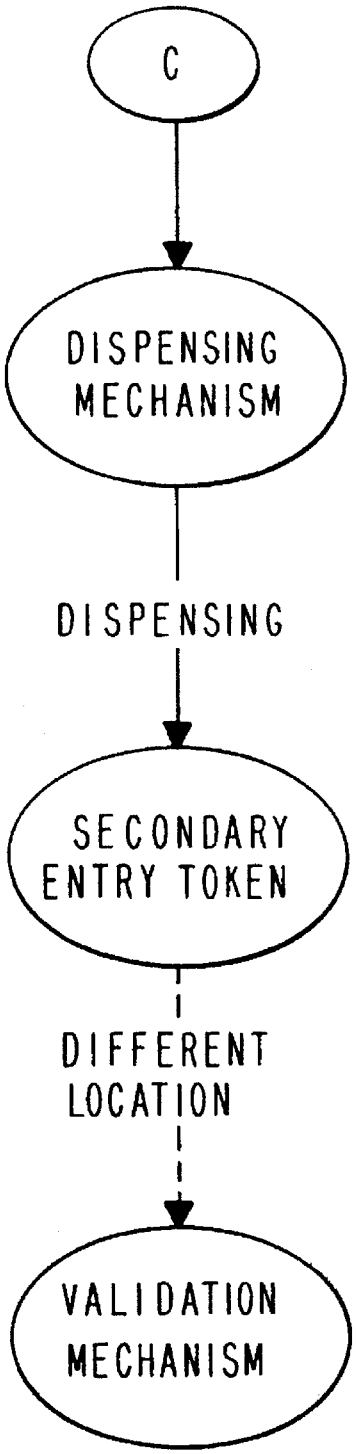
FIG. 4 is a schematic flow chart illustrating the game play process at a second or subsequent game location.

In the game playing process illustrated in the flow chart of FIG. 2, the game entry piece is generated and distributed at the participating establishment. The participant then presents the entry piece for validation and comparison with the list of winning entries to determine its winning status. The validation mechanism determines (either on-site or by communication link with a central location) whether or not the entry piece represents a winner and, if so, the holder of the winning entry is immediately notified. The winner may be notified by any suitable display means such as a video display, a printed display or the like. The validation process also serves to determine if a secondary or subsequent game is available. If so, the display for the validation process, whether winner or loser, immediately produces an entry piece for the second or subsequent game.

As illustrated in FIG. 3, the second game entry piece may be a graphic print-out from a suitable print mechanism such as a laser printer, impact printer, thermal printer or the like which displays certain information for and about the participant. For example, the second game entry piece may be in the form of a coupon 10 which contains graphic information 11 relating to the second game prizes with directions 12 to the site of a second game participating location. On the same coupon 10, the printer forms an entry piece (in the form of a bar code 13 in the illustrated embodiment) and may include additional coded information 14 relative to the particular player, the location of the game, the time of day or any other information desired to be captured at the location of the second participating game.

It will be appreciated that one or more secondary games may be operated simultaneously and that such secondary games may be operated serially or in parallel. For example, depending on the information captured at the first location such as age, sex, residence location, telephone number, type of entry piece, time of day, product purchased, etc., which is specific to any participant (some of which may be captured from unique, non-duplicating entry pieces and some of which may be collected from the participants using common entry pieces), the means for generating the secondary game entry piece may select between two or more secondary games and generate a secondary game entry piece directing or referring the participant to only one or more of the two or more secondary games being played simultaneously.

The inventive concept, of course, is not limited to play involving only two games. Each secondary game may, if desired, operate in the same manner as the initial game and generate an entry piece for a third or subsequent game when the game piece for that particular game is presented for validation. Thus a series of serially operated games may be initiated from an initial game and, of course, each secondary game may permit selective referral to one or more parallel games as discussed above.

It will further be appreciated that the universe for any secondary or subsequent game need not be limited to game pieces generated at a first game. For example, the universe of entries for the secondary game may be divided into batches, some of which are used to generate entry tokens at the initial game location and others of which may be used to generate and dispense entry pieces at the site of the secondary game. Thus one or more (related or unrelated) initial game locations may simultaneously generate and dispense entry pieces for the same secondary game while the establishment operating the secondary game may also generate and dispense entry tokens for its own game.

The advantages and information which may be derived for the tie-in referral system described herein are manifold. For example, demographic information concerning the shopping habits of the game participants, their response to various incentives, their associative response to promotional stimuli, etc., may be easily collected from their participation and the information collected can be shared and/or distributed among the participating establishments as desired. The information collected may be simply encoded on the secondary game entry coupon in raw form for capture at a subsequent game or may be captured and not encoded on the entry coupon. Such captured data may be used on-site to generate specific or demographic information or may be centrally collected for analysis.

The benefits of a single promotional game played at the initial establishment and at substantial expense can be directly tied or referred at minimal expense to establishments running secondary games. Reciprocal operations and sharing of demographic information derived form such tie-in operations yield information of unique and particular significance which cannot be readily determined from any other source.

The entry pieces generated at each location are preferably in the form of a bar code since bar codes can be readily printed by available thermal printers and the like and readily de-coded and interpreted by existing conventional equipment. However, the invention is not so limited. Various other means may be used to generate, dispense and/or read an entry token for either the initial or secondary games. Likewise, demographic information about participants may be captured and displayed or captured and not displayed, depending on the information captured and its intended use. It will be understood, therefore, that although the invention has been described with particular reference to specific embodiments thereof, the invention is not so limited. The forms of the invention shown and described in detail are to be taken as preferred embodiments. Various changes and modifications may be resorted to without departing from the spirit and scope of the invention as defined by the appended claims. Consequently, it is intended that all such modifications and equivalents are to be covered by the appended claims.

What is claimed:

1. A promotional gaming method comprising the steps of:

(a) establishing a universe of lottery numbers for a first promotional game;

(b) selecting a set of winning entries from said universe of lottery numbers;

(c) dispensing first game entry pieces for initiating play in said first promotional game; and (d) dispensing an entry piece for a second promotional game each time a first game entry piece is presented for winner determination in said first promotional game.

2. A promotional gaming method as set forth in claim 1 wherein said entry piece for a second promotional game is dispensed substantially simultaneously with display of the winner determination status of said first game entry piece.

3. A promotional gaming method as set forth in claim 1 including the step of collecting demographic information about the participant to which a first game entry piece is dispensed.

4. A promotional gaming method as set forth in claim 3 wherein said demographic information is recorded on said entry piece for a second promotional game.

5. A promotional gaming method as set forth in claim 1 including the step of collecting information about participants which present said entry piece for a second promotional game for validation at such second promotional game.

6. A promotional gaming method as defined in claim 1 wherein the dispensing of said entry piece for a second promotional game is selected from two or more available second promotional games.

7. A promotional gaming method as set forth in claim 1 wherein each of said first game entry pieces is unique.

8. A promotional gaming method as set forth in claim 1 wherein all said first game entry pieces are substantially identical.

9. A promotional gaming method as set forth in claim 1 wherein each said entry piece for a second promotional game is unique.

10. A promotional gaming method as set forth in claim 1 wherein all said entry pieces for a second promotional game are substantially identical.

11. A promotional gaming method as set forth in claim 1 wherein said winning entries are randomly selected.

12. The method of operating consecutive promotional games wherein the winner status of game entry pieces is determined and displayed upon presentation of an entry piece for winner determination comprising the steps of:

(a) establishing a first promotional game;

(b) establishing a second promotional game;

(c) distributing game entry pieces for initiating play on said first promotional game;

(d) displaying the winner status of each game entry piece presented for winner determination in said first promotional game; and (e) dispensing an entry piece for said second promotional game substantially simultaneously with displaying the winner status of each entry piece presented for winner determination in said first promotional game.

13. The method of claim 12 including the step of collecting demographic information about the participant to which a first game entry piece is dispensed.

14. The method of claim 13 wherein said demographic information is recorded on said entry piece for recovery at said second promotional game.

15. The method of claim 12 wherein the dispensing of said entry piece for said second promotional game is selected from two or more available second promotional games.

16. The method of claim 12 wherein each of said first game entry pieces is unique.

17. The method of claim 12 wherein all said first game entry pieces are substantially identical.

18. The method of claim 12 wherein each said entry piece for a second promotional game is unique.

19. The method of claim 12 wherein all said entry pieces for a second promotional game are substantially identical.

20. The method of operating consecutive promotional games wherein selected winning entries are determined upon presentation of an entry piece for winner determination status comprising the steps of:

(a) establishing a first universe of lottery numbers for a first promotional game;

(b) selecting a set of winning entries from said first universe of lottery numbers;

(c) establishing a second universe of lottery numbers for a second promotional game;

(d) selecting a set of winning entries from said second universe of lottery numbers;

(e) distributing entry pieces for initiating play on said first promotional game;

(f) displaying the winner status of each entry piece presented for winner determination in said first promotional game; and (g) dispensing an entry piece for said second promotional game substantially simultaneously with displaying the winner status of each entry piece presented for winner determination in said first promotional game.

21. The method set forth in claim 20 wherein the winning entries are randomly selected from each universe of lottery numbers.

22. The method set forth in claim 20 including the step of collecting demographic information about participants in both said first and second promotional games.

23. The method set forth in claim 20 wherein said demographic information is relayed to and collected at a site remote from the location of play of either said first or second promotional game.

* * * * *